US010619360B2

(12) United States Patent
Johnston et al.

(10) Patent No.: US 10,619,360 B2
(45) Date of Patent: Apr. 14, 2020

(54) EDGE GUARD FOR AREA RUG

(71) Applicant: Tarkett USA Inc., Solon, OH (US)

(72) Inventors: Curt Johnston, Chagrin Falls, OH (US); Terrance Arthur Mowers, Lookout Mountain, TN (US)

(73) Assignee: Tarkett USA Inc., Solon, OH (US)

( * ) Notice: Subject to any disclaimer, the term of this patent is extended or adjusted under 35 U.S.C. 154(b) by 0 days.

(21) Appl. No.: 16/004,938

(22) Filed: Jun. 11, 2018

(65) Prior Publication Data

US 2018/0355621 A1 Dec. 13, 2018

Related U.S. Application Data

(60) Provisional application No. 62/517,448, filed on Jun. 9, 2017.

(51) Int. Cl.

| | |
|---|---|
| ***E04C 2/38*** | (2006.01) |
| ***E04F 19/06*** | (2006.01) |
| ***A47G 27/04*** | (2006.01) |

(52) U.S. Cl.

CPC ..... *E04F 19/061* (2013.01); *A47G 27/0431* (2013.01)

(58) Field of Classification Search

None

See application file for complete search history.

(56) References Cited

U.S. PATENT DOCUMENTS

| | | | | | |
|---|---|---|---|---|---|
| 2,258,314 | A | * | 10/1941 | Bonnell | A47G 27/0462 16/16 |
| 2,820,980 | A | * | 1/1958 | Karas | A47G 27/0462 16/7 |
| 2,926,378 | A | * | 3/1960 | Eichhorn | A47G 27/0462 16/4 |
| 2,980,943 | A | * | 4/1961 | Calandro | A47G 27/0462 16/16 |
| 3,514,914 | A | * | 6/1970 | Bergquist | A47G 27/0456 52/273 |
| 3,745,606 | A | * | 7/1973 | Matthey | A47G 27/06 16/10 |
| 4,054,698 | A | * | 10/1977 | Hamrah | A47G 27/0431 16/7 |
| 4,654,245 | A | * | 3/1987 | Balzer | A47L 23/26 428/192 |

(Continued)

FOREIGN PATENT DOCUMENTS

| | | | |
|---|---|---|---|
| GB | 2341795 | A | 3/2000 |
| JP | 2001275819 | A | 10/2001 |

(Continued)

*Primary Examiner* — Basil S Katcheves

(74) *Attorney, Agent, or Firm* — Walter | Haverfield LLP; D. Peter Hochberg; Sean F. Mellino

(57) ABSTRACT

An edge guard for an area rug that includes a transition configured as a partial ovoid with a flat underside for engaging a floor or subfloor, a forwardly disposed toe forming the forward free end of the ovoid, an upwardly extending top portion terminating in a rearward lip, the lip forming a free end of the underside, a top portion extending over the underside, and a receiver extending towards the lip for receiving the edge of a floor covering and forming a forward wall, with a glue strip extending from the lower part of the forward wall to which the floor covering can be attached to the edge guard.

7 Claims, 10 Drawing Sheets

(56) References Cited

U.S. PATENT DOCUMENTS

| | | | | |
|---|---|---|---|---|
| 5,706,623 | A | 1/1998 | Brown | |
| D394,776 | S * | 6/1998 | Callas | D6/587 |
| 6,093,469 | A * | 7/2000 | Callas | A47L 23/266 428/95 |
| D439,462 | S * | 3/2001 | Callas | D6/587 |
| 7,043,792 | B2 * | 5/2006 | Kessler | A47L 23/266 15/215 |
| 7,540,067 | B2 * | 6/2009 | Colbourne | A47G 27/0418 16/7 |
| 8,186,114 | B2 * | 5/2012 | Rissone | E06B 7/2316 49/467 |
| 8,298,642 | B2 | 10/2012 | Yuan et al. | |
| 10,173,351 | B2 | 1/2019 | Mooney et al. | |
| 2004/0168381 | A1 * | 9/2004 | Rissone | E06B 1/70 52/211 |
| 2005/0189723 | A1 * | 9/2005 | Chassee | A47G 27/045 277/411 |
| 2008/0313850 | A1 | 12/2008 | Pongrac | |
| 2018/0355621 | A1 * | 12/2018 | Johnston | E04F 19/061 |

FOREIGN PATENT DOCUMENTS

| | | | |
|---|---|---|---|
| JP | 6413797 | B2 | 10/2018 |
| KR | 20000007092 | U | 2/2000 |

* cited by examiner

EDGE GUARD FOR AREA RUG

CROSS-REFERENCE TO RELATED APPLICATION

This application claims priority of U.S. Provisional Application No. 62/517,448 filed on Jun. 9, 2017 of which is incorporated herein by reference in its entirety.

BACKGROUND OF THE INVENTION

Field of the Invention

This invention relates to edge guards respectively having, in particular, transitions between a rug or carpet and a subfloor or floor, and more specifically to an area rug for transitioning to zero tolerance (the subfloor).

Description of the Prior Art

Transitions are known for providing a smooth transition between the interface of different types of floor covering, such as between carpeting and floors or subfloors, carpeting and tile, tile and carpet, and the like. Floor transitions, or transitions, are used for many reasons. For one, they provide an aesthetic appearance since they many times provide a smooth border between a floor or subfloor and a floor covering, and between two types of floor coverings. Another reason is for safety since, if the floor or subfloor and the floor covering, or the two floor coverings have different heights, it is possible that a person crossing the border between the floor or subfloor and the floor covering, or the two types of floor coverings, may trip if these are at different heights. Additionally, if they are in places where wheeled carts travel, such as in hospitals where gurneys, bedside carts, medical carts, food service carts, instrument carts and the like are used, a smooth overlay between different heights of floors or subfloors and floor coverings, or adjacent floor coverings, avoid uncomfortable jostling and sometimes dangerous movements. Furthermore, providing a transition will lessen the discernment of changes in a floor surface by persons walking from a floor or subfloor and a floor covering, to another floor or floor covering since the person is less likely to feel the difference between rigid and carpeted floors.

The American's with Disabilities Act (ADA) discusses transitions for beveled edges when the height exceeds one quarter inch. Relevant parts of Chapter 3: Building Blocks, provide as follows:

302 Floor or Ground Surfaces

- 302.1 General. Floor and ground surfaces shall be stable, firm, and slip resistant and shall comply with 302.
- 302.2 Carpet. Carpet and carpet tile shall be securely attached and shall have a firm cushion, pad, or backing or no cushion or pad. Carpet or carpet tile shall have a level loop, textured loop, level cut pile, or level cut/uncut pile texture. Pile height shall be ½ inch (13 mm) maximum. Exposed edges of carpet shall be fastened to floor surfaces and shall have trim on the entire length of the exposed edge. Carpet edge trim shall comply with 303.
- Advisory 302.2 Carpet. Carpets and permanently affixed mats can significantly increase the amount of force (roll resistance) needed to propel a wheelchair over a surface. The firmer the carpeting and backing, the lower the roll resistance. A pile thickness up to ½ inch (13 mm) (measured to the backing, cushion, or pad) is allowed, although a lower pile provides easier wheelchair maneuvering. If a backing, cushion or pad is used, it must be firm. Preferably, carpet pad should not be used because the soft padding increases roll resistance.
- Carpeting must be securely attached so that it does not shift or buckle against wheeled traffic. Cushions or pads, if used, also must be properly secured to resist movement. Rolling or buckling occurs when carpet is not properly secured and makes wheelchair maneuvering very difficult.
- Exposed edges must have trim on the entire length of the exposed edge and be fastened to the floor to prevent curling. Trim must meet specifications for changes in level, including requirements for beveled edges when the height exceeds ¼ inch. The maximum height is ½ inch. See FIGS. 1 and 2.

There are many types of transitions within the art. U.S. Pat. No. 2,258,314 provides an edge molding for securing the edge of carpets, linoleum or other floor or wall coverings to the surface to be ornamented or protected. This of molding is large, readily noticeable and somewhat difficult to install. A rather complex device is shown in U.S. Pat. No. 2,820,980, which provides a combined binding and anchoring portion for protecting the marginal edge of floor coverings, such as carpet and the normal floor, and requires the use of fasteners to secure the device to the floor.

There are various transitions for use between tile floors and carpeting, including those for use between hard tiles and carpet tiles. One type of transition is incorporated in an edge guard. As used herein, an edge guard protects persons and vehicles from tripping or being jarred by the edge of a rug, carpet tile, or flexible or hard tiles, as well as protecting the latter products from persons or vehicles crossing them. Edge guards incorporate transitions, as well as in the present situation, glue strips.

SUMMARY OF THE INVENTION

An object of the present invention is to provide an edge guard including a transition between a hard flooring surface such as a subfloor and a rug or carpet floor covering.

Another object of the present invention is to provide an edge guard with a transition between a tile floor covering and a carpet floor covering.

It is another object of the present invention to provide an edge guard comprising a transition between a vinyl tile and a floor or subfloor.

It is yet a further object of the present invention to provide an edge guard with a transition between a rug, a tile, or a carpet tile, and which frames the rug tile or carpet tile.

Another object is to provide an edge guard including a transition and a glue strip. The glue strip is used to attach a rug, carpet tile, flexible tile or a hard tile to the edge guard.

It is yet a further object of the present invention to provide an effective and efficient transition between rugs and floors or subfloors, which is relatively easy to manufacture, aesthetic and effective in use and simple to install and use.

DESCRIPTION OF THE PREFERRED EMBODIMENTS

An edge guard 100 comprising a transition 1 for floor covering including a vinyl tile and carpet tile is shown in each of FIGS. 3-6, 6A and 7-15.

Figure 1:
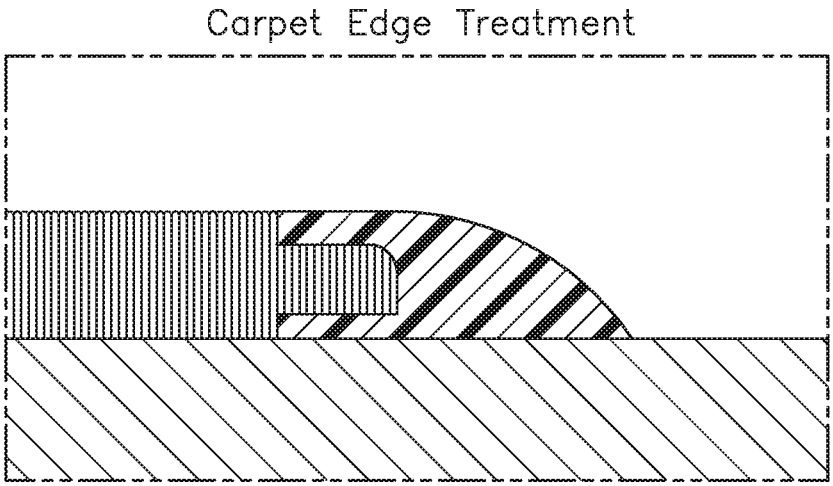
FIG-1 Prior Art
FIG. 1 is a transition published by the Access Board of the ADA.
Figure 2:
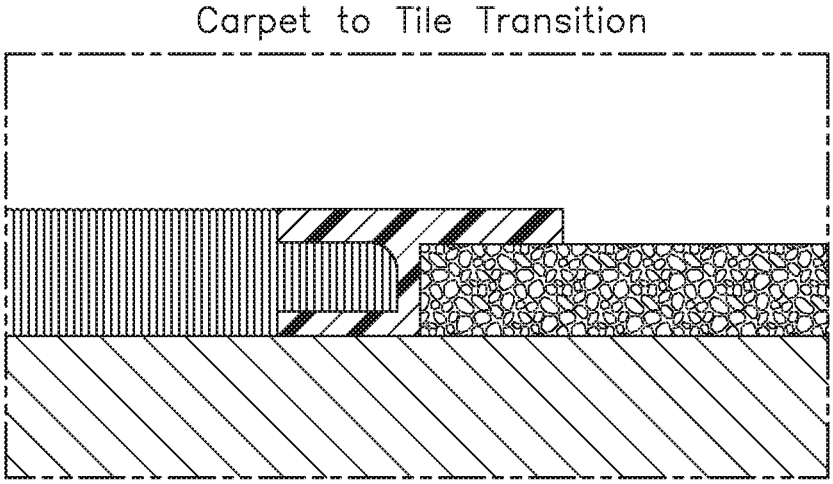
FIG-2 Prior Art
FIG. 2 is another transition published by the Access Board of the ADA.
Figure 3:
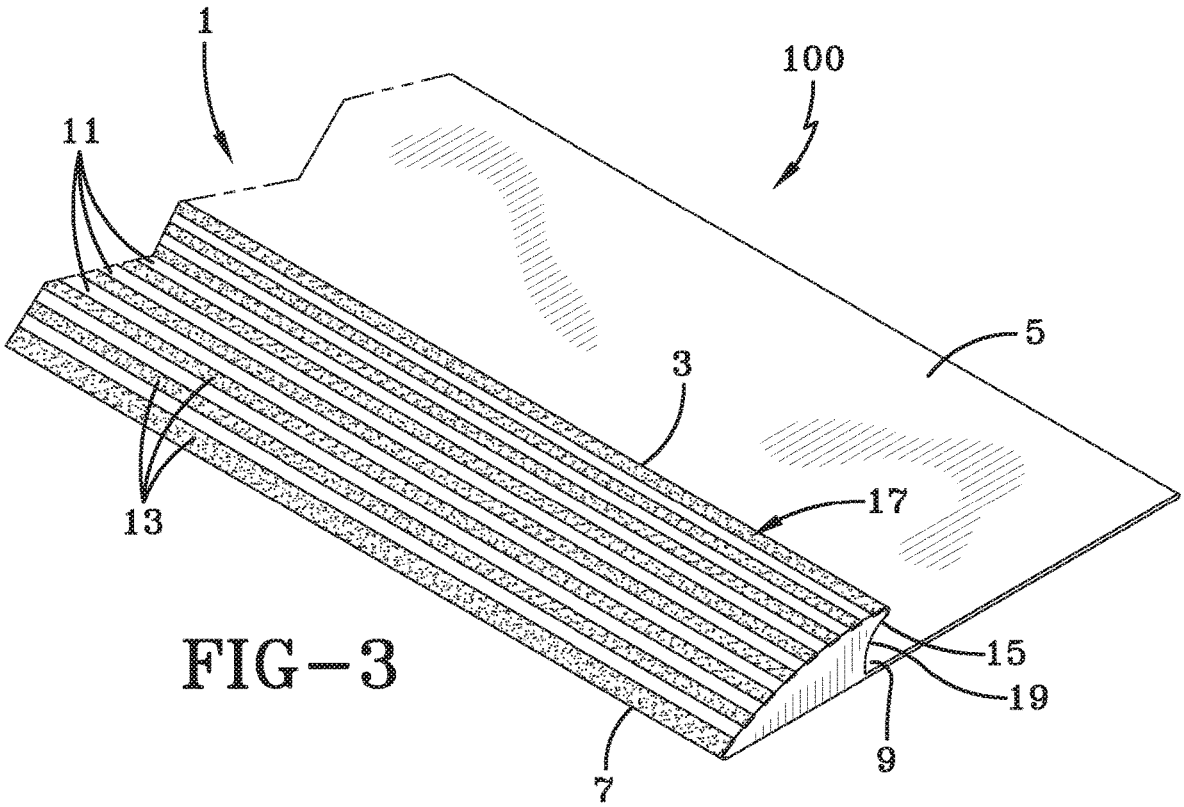
FIG. 3 is a perspective view of an edge guard comprising a transition for use with a rug according to a preferred embodiment of the invention.
Figure 14:
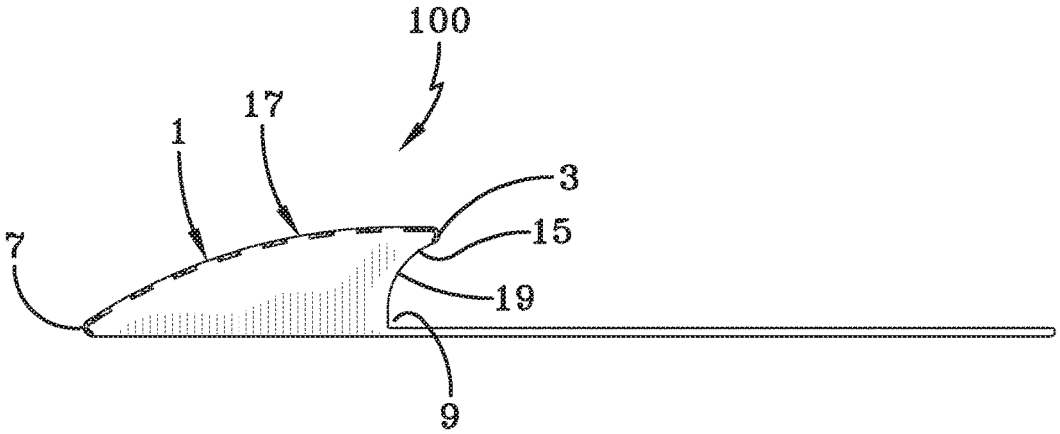
FIG. 14 is a side view of an edge guard according to a preferred embodiment of the invention having a different configuration from those shown in FIGS. 10, 11 and 13.

FIG. 3 is a perspective view of edge guard 100. Edge guard 100 comprises a transition 1 which is composed of a forwardly disposed upwardly extending top portion 17 made of solid material and includes a lip 3 on an upstanding free end of top portion 17 of transition 1. A glue strip 5 extends from a toe 7 of transition 1 which is at a juxtaposition the base of transition 1 and top portion 17 of transition 1, along the underside of top portion 17 and having a flat underside for engaging a floor or subfloor. Glue strip 5 has a flat upperside rearward of top portion 17. Top side and bottom side of glue strip 5 terminate rearward at a rearward free end. A receiver 9 is located between transition 1 and glue strip 5 for receiving the edge of floor covering such as a rug, tile, carpet tile and vinyl tile. Receiver 9 is defined by a forward wall 19 and the portion of glue strip 5 in the vertical projection of forward wall 19. Variations of receiver 9 are shown in FIGS. 3, 5, and 8-14. Receiver 9 has a rearward facing surface which is preferably concave. Top portion 17 of transition 1 is essentially a partial flattened egg shaped or partial, flattened portion of an ovoid as shown most clearly in FIGS. 5 and 9-14 discussed below.

A series of parallel stripes 11, 13 extend horizontally across the top of transition 1. Stripes 11 are lighter in color than the rest of edge guard 100, and are preferably coextruded along with the extrusion process used to form edge guard 100. Stripes 13 are a portion of the material from which the balance (other than stripes 11) are made. The latter material is preferably flexible PVC, and the colors can be arbitrarily selected. Stripes 11, 13 can be solely aesthetic, but also could serve as a warning of the presence and location of the edge guard 100.

Although stripes 11, 13 can be part of a smooth surface, one color stripe may be slightly raised over the adjacent stripe(s). That is, stripes 11 and 13 can be alternately raised and lowered relative to respective adjacent stripes. However, this makes no difference in the functioning of edge guard 100, but can be aesthetically pleasing and can warn pedestrians of the presence of transitions 1.

A rug R or other floor covering is installed in receiver 9 when edge guard 100 is in use. As explained below, rug R is held firmly in place by lip 3 so that rug R cannot slip out of receiver 9 and dirt cannot move between rug R and receiver 9.

One way of securing rug 9 to edge guard 100 is by the use of an appropriate adhesive that is used to cover all or part of glue strip 5. A preferable adhesive is Johnsonite #945. Johnsonite #945 is a proprietary product of Johnsonite, Inc., a subsidiary of Tarkett USA Inc. Johnsonite #945 is a nonflammable, solvent free, neoprene latex based contact adhesive. It produces a high-strength, water resistant bond immediately upon contact. Johnsonite #945 contains no hazardous or carcinogenic ingredients defined by OSHA, federal or state agencies.

Other glues having desired characteristics can be used. Contact adhesive tapes as appropriate can be employed as well. The glue could also be applied to the underside of the rug or tile provided a firm and durable adhesive of the rug or tile to the glue strip is obtained.

FIGS. 9-14 are side views of preferred embodiments of edge guard 100. The same identification numbers are used even though some of the dimensions are changed between the different preferred embodiments. Lip 3 is dimensioned so that if edge guard 100 is used with a carpet tile, the carpet tile pushes upwardly on the lip to prevent a person's toe from sliding under the lip to prevent tripping or stumbling. If a tile is used with edge guard 100, lip 3 bites into the tile to prevent dirt from going between the tile and the lip to prevent tripping or stumbling. There is zero tolerance at toe 7 and the subfloor to avoid a trip hazard.

There is a rounded upper surface on an upper portion or taper 15 on transition 1 forming the upper part of receiver 9 and coinciding with front wall 19 of receiver 9. This causes tiles to bite into the top of receiver 9. This rounded upper surface or taper 15 also affects the firm gripping of rug fibers to avoid the tripping hazard discussed earlier. Taper 15 prevents the fracturing thereof.

Figure 15:
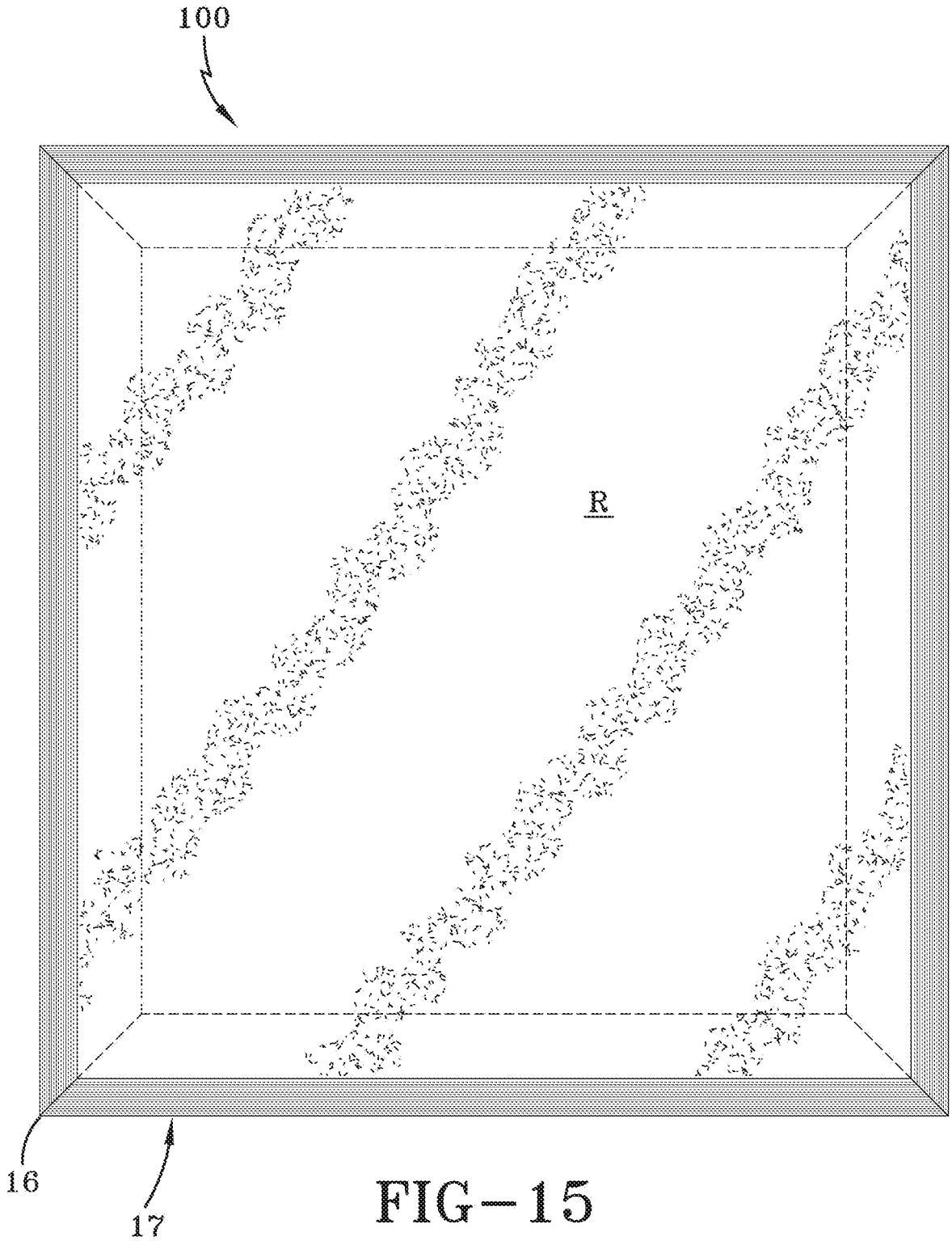
FIG. 15 is a top view of a set of edge guards framing an area rug.

Edge guard 100 can be used to frame an area rug. Referring to FIG. 15, a set of four edge guards 100 are mitered and joined at seams or intersections 16 to form a frame 17. Seams 16 are preferably attached to each other by adhesive tape or a glue as discussed above. Edge guards could be arranged in any way to frame a rug of any type.

Figure 16:
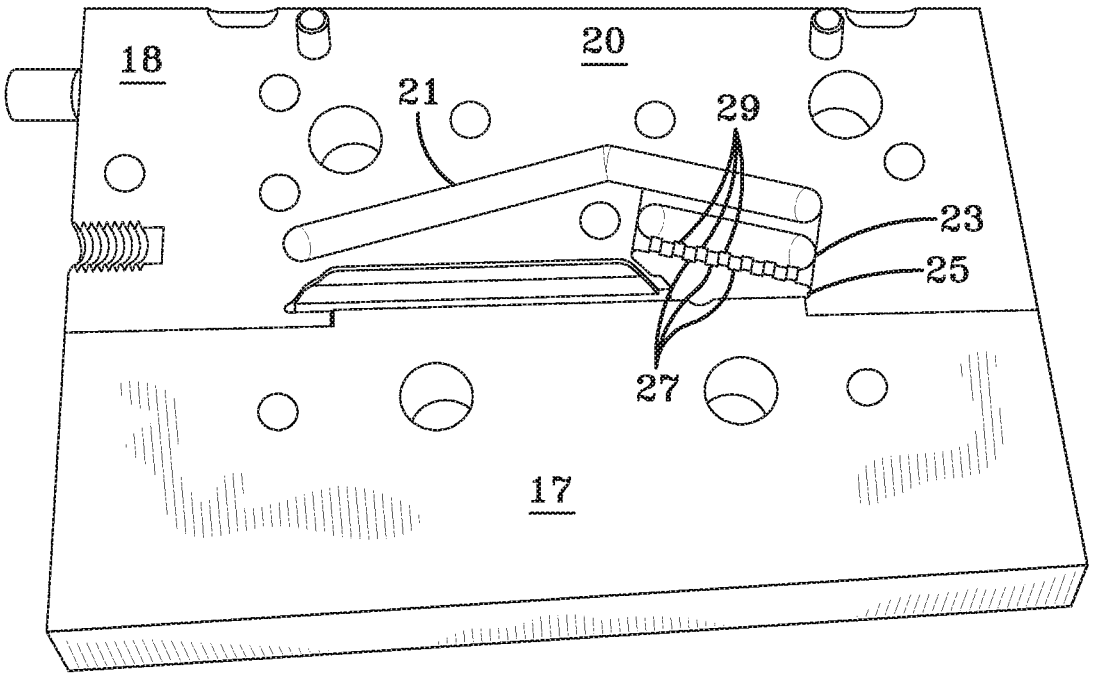
FIG. 16 is a front view of a die adapter for use in molding an edge guard according to a preferred embodiment of the invention.

Edge guard 100 is preferably manufactured using conventional extrusion equipment with a special die apparatus. The PVC is heated in the extrusion apparatus, and the extruded material first flows through an extruder adapter to a die adapter 31 shown in FIG. 16. Die adapter 31 cooperates with a die block 33. A face plate 20 has a coextruded feed channel 21 and an extension feed channel 23. A small dam 25 extends between feed channel 21 and extension feed channel 23. In order to coextrude stripes 11, 13, there are alternating recesses 27 and raised portions 29. Raised portions 29 are for the black (assuming the main extrusion material is black) extrusion material and recessed portions 27 are for the lighter colored secondary extrusion material. The secondary extrusion material is a top coat.

Figure 17:
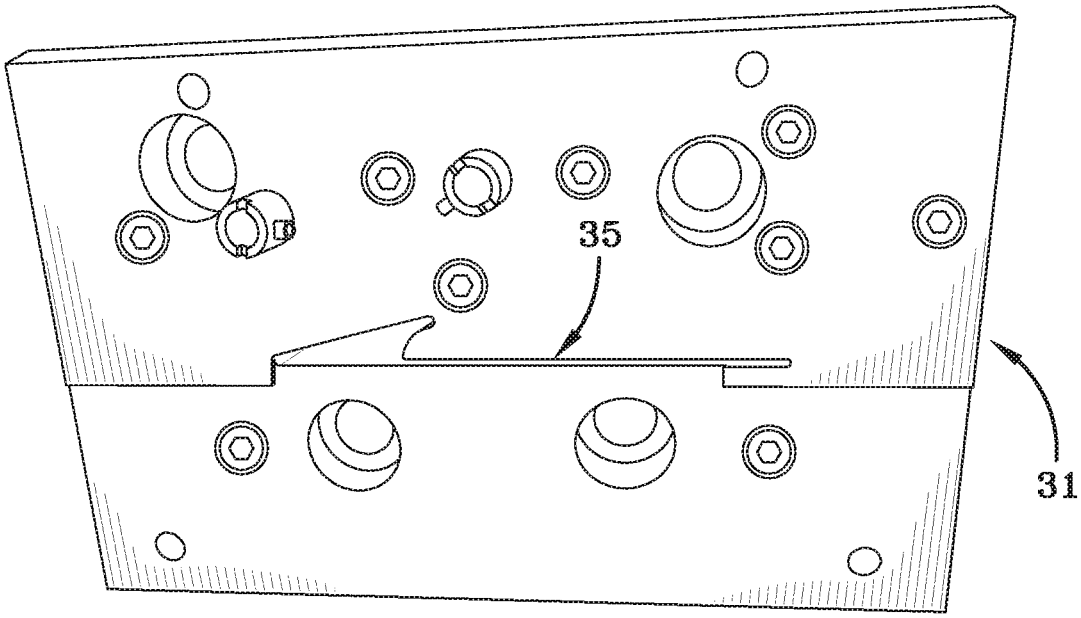
FIG. 17 is a front view of a die block used in conjunction with the die adapter shown in FIG. 16 for molding an edge guard according to a preferred embodiment of the invention.

FIG. 17 illustrates a die adaptor 31 and a die block 33. Die adapter 31 has a die 35 showing the final shape of edge guard 100. Die 35 is lower than edge guard 100 being molded thereby because the molded part proceeds through a drawback process as edge guard shrinks after it is extruded through die 35.

Figure 4:
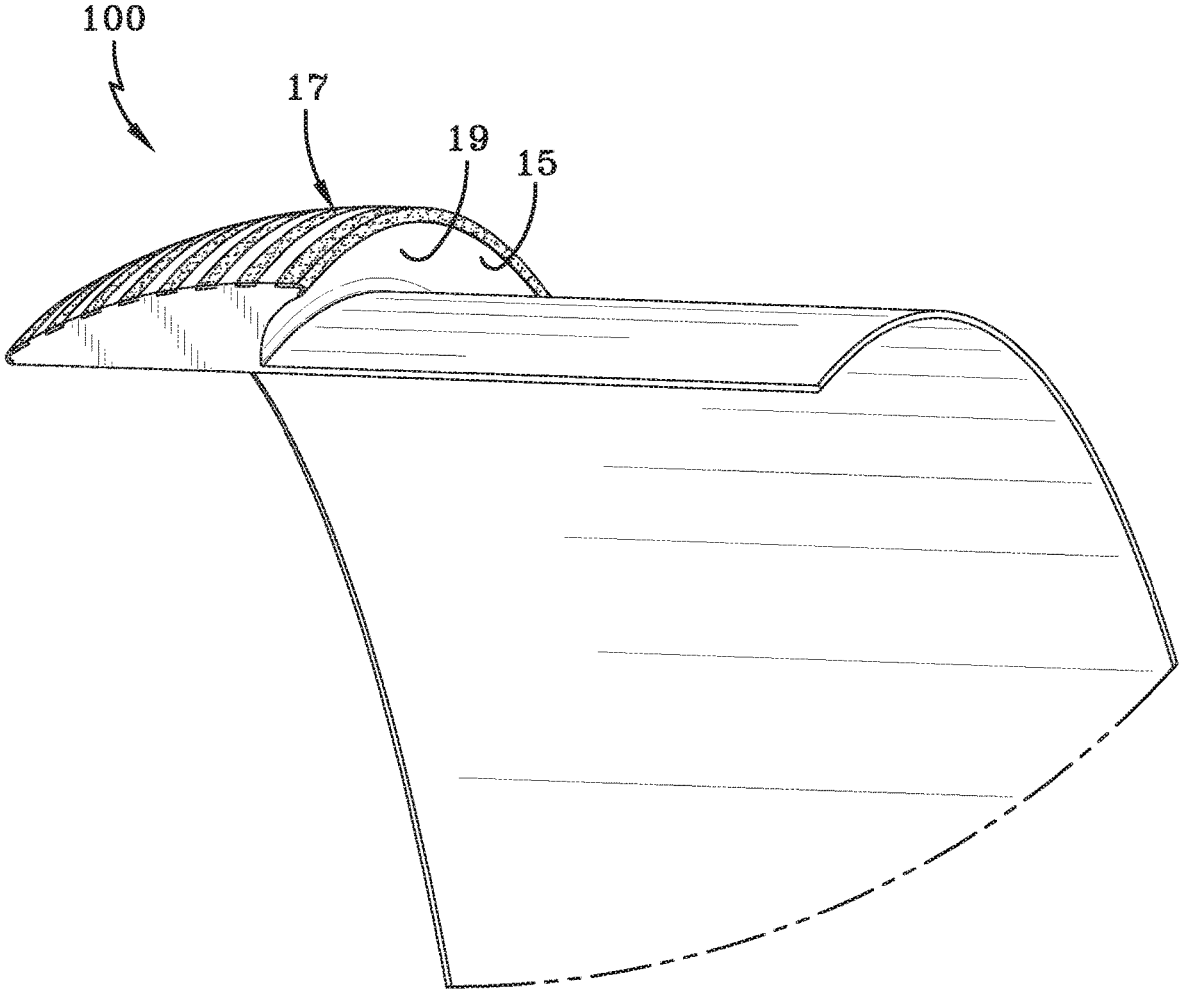
FIG. 4 is a partial, perspective view of the edge guard shown in FIG. 3 of an edge guard according to a preferred embodiment of the invention on a supply roll for storage of such edge guards.
Figure 5:
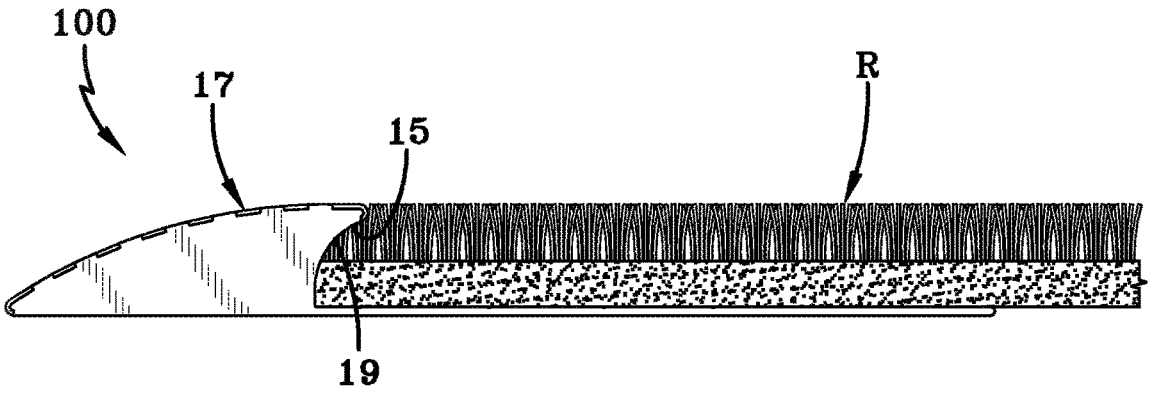
FIGS. 5 and 6 are respectively a side view and a top view of an edge guard according to a preferred embodiment of the invention in which a carpet has been installed.
Figure 7:
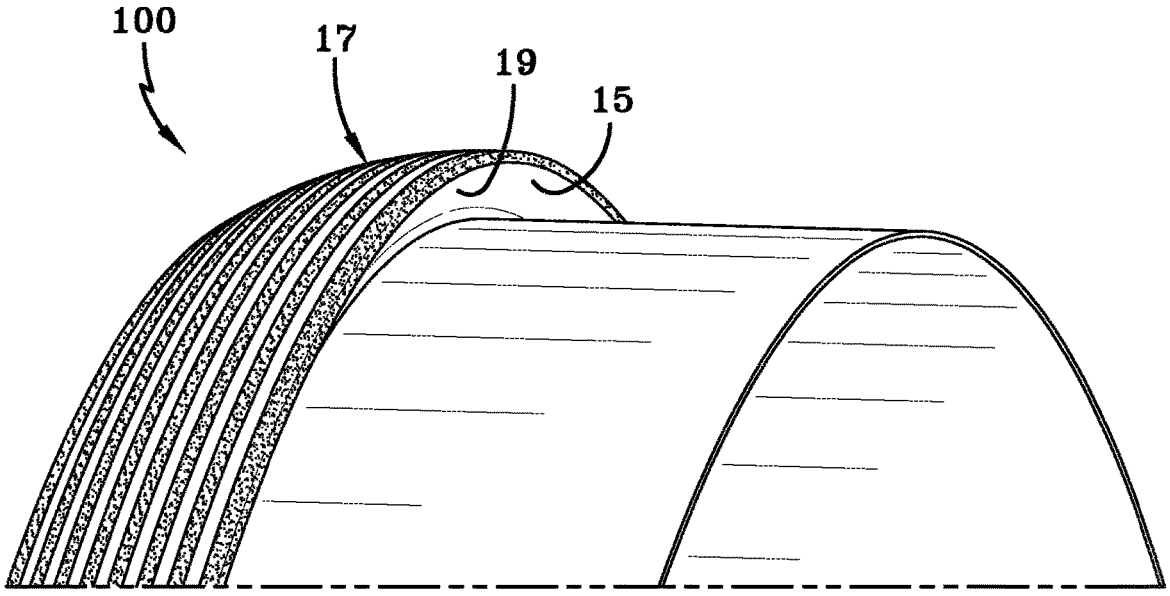
FIG. 7 is another perspective view of the edge guard on a supply roll as shown in FIG. 4.
Figure 6:
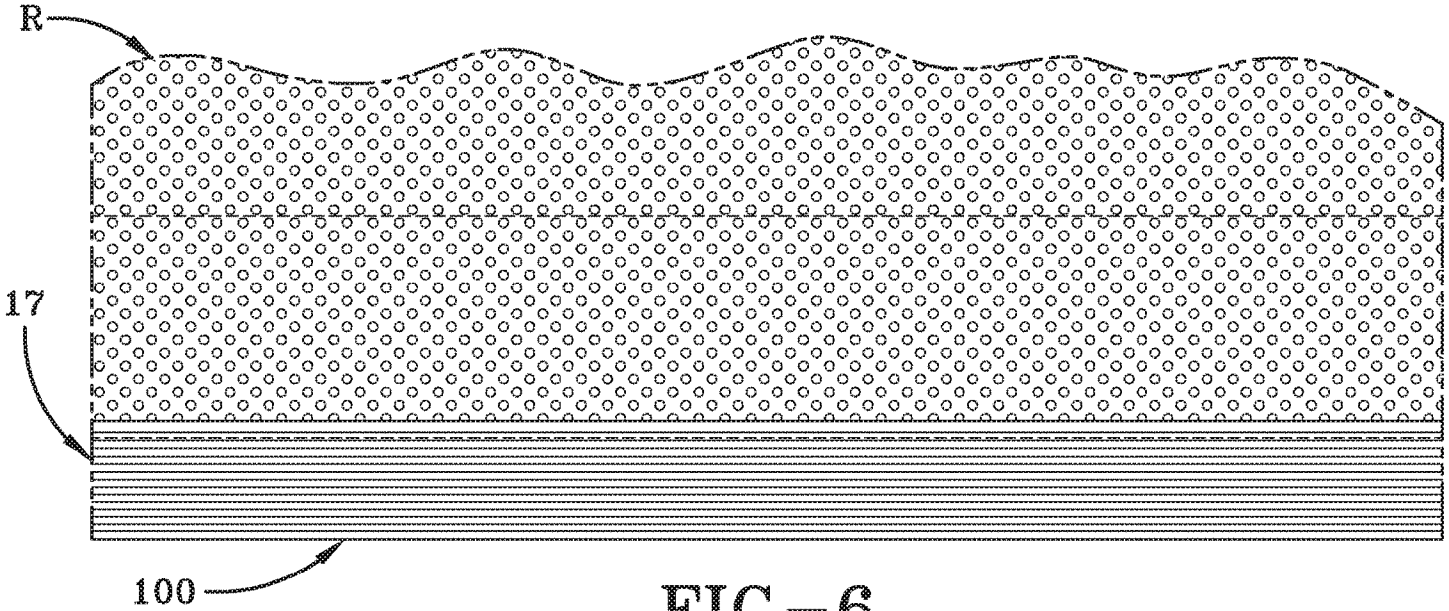
Figure 6A:
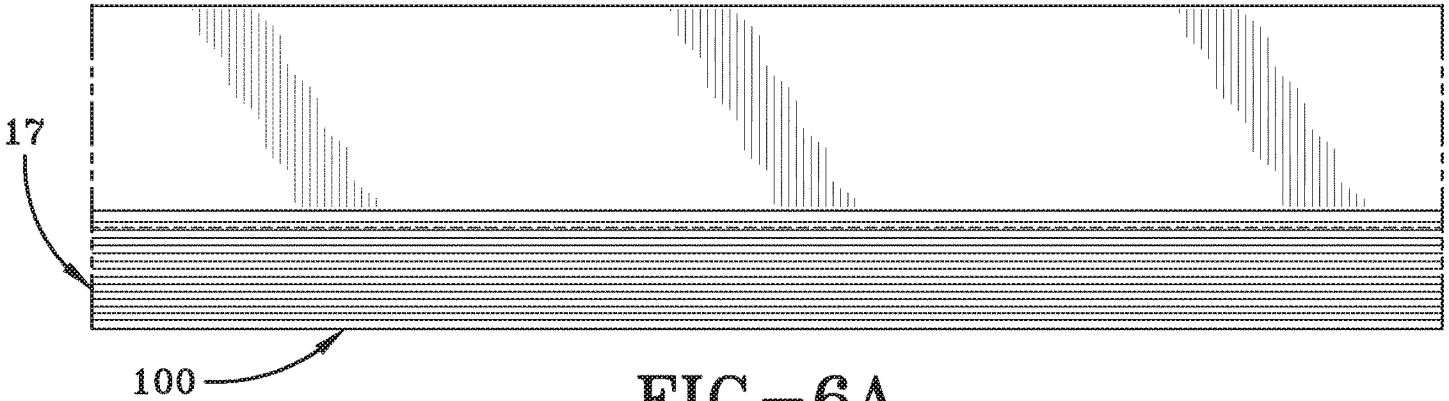
FIG. 6A is a top view of the edge guard shown in FIGS. 5 and 6 without a carpet having been installed thereon.
Figure 8:
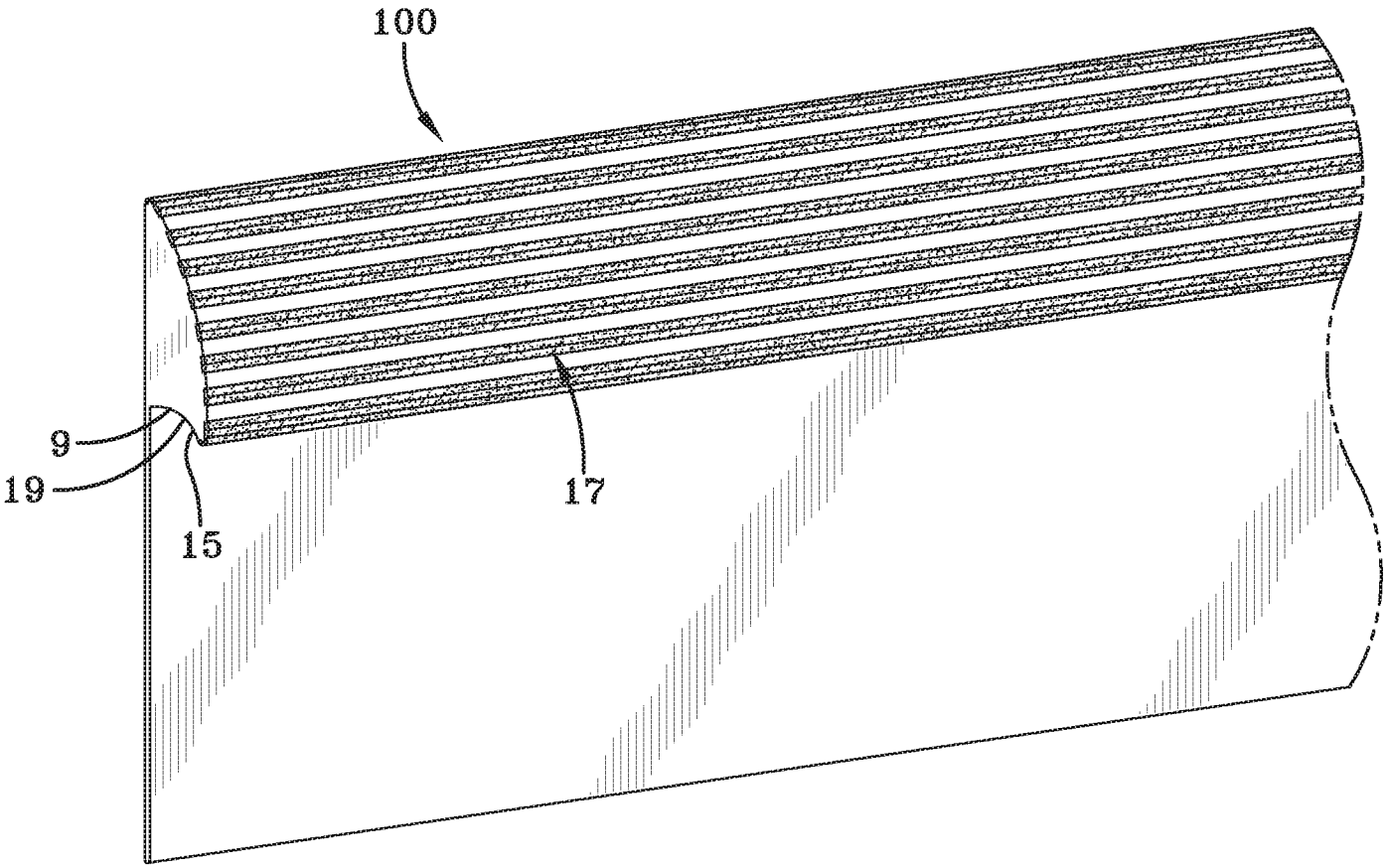
FIG. 8 is a partial perspective view of an edge guard according to a preferred embodiment of the invention.
Figure 9:
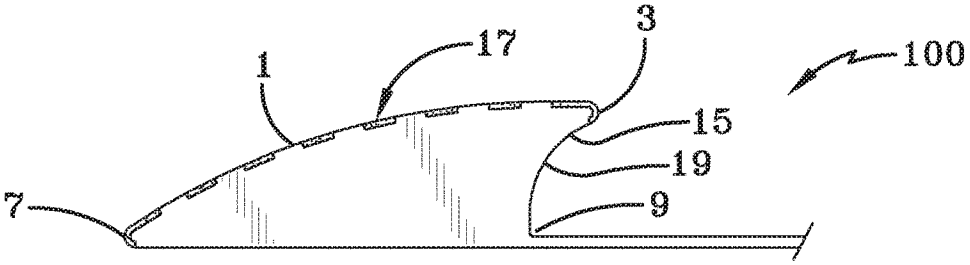
FIG. 9 is a partial side view of an edge guard according to a preferred embodiment of the invention.
Figure 10:
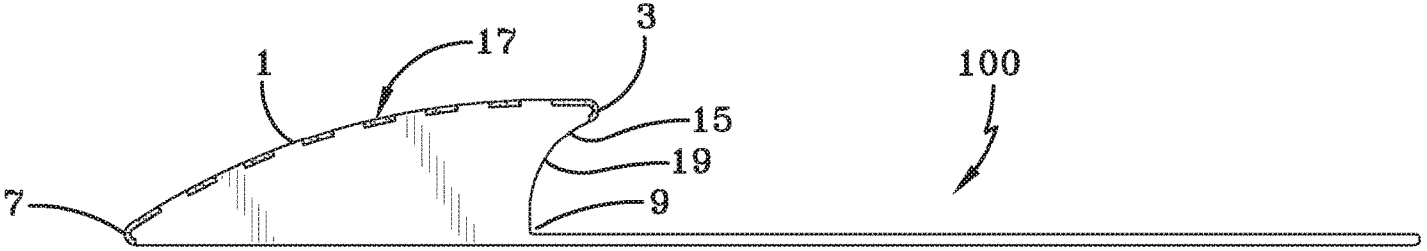
FIGS. 10 and 11 are side views of two different sizes of edge guards according to a preferred embodiment of the invention.
Figure 11:
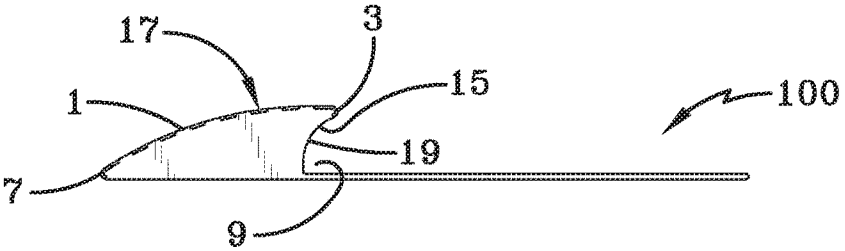
Figure 12:
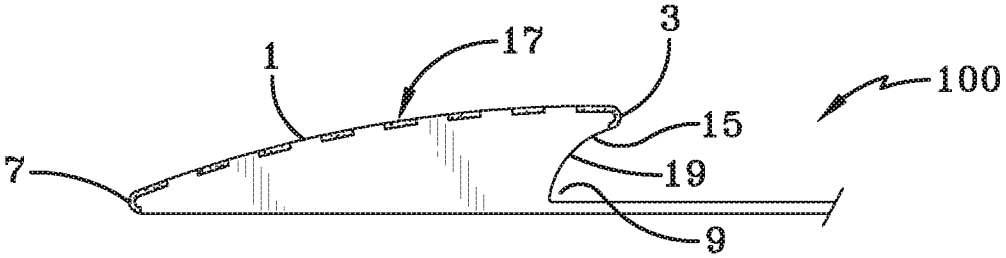
FIG. 12 is a partial side view of an edge guard according to a preferred embodiment of the invention having a different configuration from that shown in FIG. 9.
Figure 13:
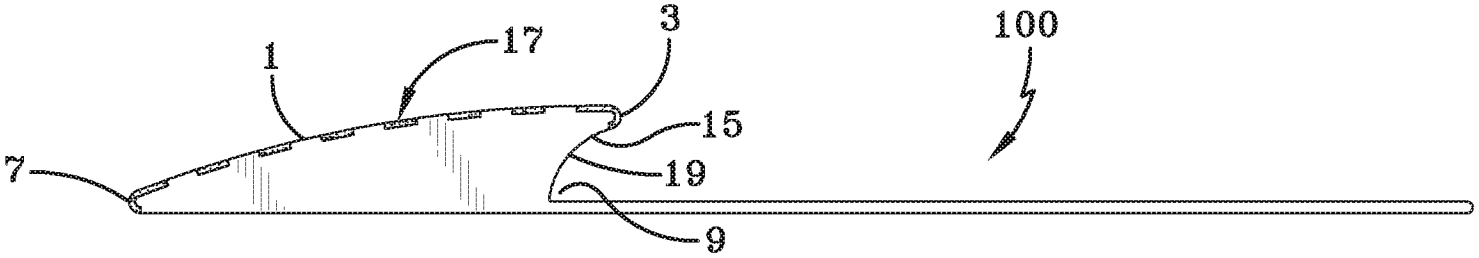
FIG. 13 is a side view of an edge guard according to a preferred embodiment of the invention having a different configuration from that shown in FIGS. 6, 9-12 and 14.

Edge guard 100 is preferably extruded and stored in rolled form. From such rolls particular lengths are cut for use with selector floor coverings. It has been found that twelve foot lengths are advantageous in this regard. Portions of such rolls are shown in FIGS. 4 and 7.

The invention has been described in detail with emphasis being made to the most significant parts thereof, but variations and modifications may occur to those skilled in the art to which the invention pertains.

The invention claimed is:

1. An edge guard for a floor covering, said edge guard comprising:

a transition including a forward portion and a rearward portion, said transition comprising:

a forwardly disposed upwardly extending top portion made of substantially solid material in the form of a portion of an ovoid in configuration, said forwardly disposed upwardly extending top portion comprising a forwardmost portion, a rearwardmost portion and an underside;

a glue strip extending rearwardly along the underside of the forwardly disposed upwardly extending, top portion from the forward part of said forwardly disposed upwardly extending top portion to a position rearwardly of said forwardly disposed upwardly extending top portion, said glue strip including a flat underside for engaging a floor or subfloor and a flat upperside disposed rearwardly of said forwardly disposed upwardly extending top portion, said flat underside and said flat upperside of said glue strip terminating in a rearward free end;

said solid material of said upwardly extending top portion including:

an uppermost surface terminating in a rearward lip;

a rearwardly facing surface extending between said rearward lip and extending over a forwardmost part of said flat upper side of said glue strip to form a receiver for receiving an edge of the floor covering;

wherein said forward portions of said forwardly disposed upwardly extending top portion and said glue strip form a toe.

2. An edge guard according to claim 1 wherein said upwardly extending top portion includes an observable design.

3. An edge guard according to claim 2 wherein said design is a set of stripes extending across said top portion.

4. An edge guard according to claim 3 wherein said transition and glue strip are an extrusion, and said set of stripes are a coextrusion.

5. An edge guard according to claim 4 wherein said stripes are parallel to each other, and said stripes are alternatively raised and lowered relative to the respective adjacent stripes.

6. An edge guard according to claim 3 wherein said stripes are parallel to each other, and said stripes are alternatively raised and lowered relative to the respective adjacent stripes.

7. An edge guard according to claim 1 wherein said rearwardly facing surface is concave in configuration and includes a taper to prevent fracture of said upwardly extending top portion.

* * * * *